US007234241B2

(12) United States Patent
Chu

(10) Patent No.: US 7,234,241 B2
(45) Date of Patent: Jun. 26, 2007

(54) POCKETKNIFE WITH A LOCK ASSEMBLY

(76) Inventor: Chi-Tung Chu, No. 9, Alley 7, Lane 118, Syh-Wei Rd., Wu-Ku Hsiang, Taipei Hsien (TW)

( * ) Notice: Subject to any disclaimer, the term of this patent is extended or adjusted under 35 U.S.C. 154(b) by 196 days.

(21) Appl. No.: 11/152,343

(22) Filed: Jun. 15, 2005

(65) Prior Publication Data

US 2006/0283021 A1 Dec. 21, 2006

(51) Int. Cl.
*B26B 3/06* (2006.01)

(52) U.S. Cl. ..... 30/160; 30/161

(58) Field of Classification Search ..... 30/155, 30/160, 161

See application file for complete search history.

(56) References Cited

U.S. PATENT DOCUMENTS 1,357,398 A * 11/1920 Haywood ..... 30/161
1,362,142 A * 12/1920 Rohrer ..... 30/161
3,783,509 A * 1/1974 Lake ..... 30/161
4,133,106 A * 1/1979 Addis ..... 30/160
5,522,138 A * 6/1996 Betts, Jr. ..... 30/160
6,684,510 B1 * 2/2004 Collins ..... 30/161
6,701,621 B2 * 3/2004 Kain et al. ..... 30/160
7,174,590 B1 * 2/2007 Quenzi ..... 7/158

* cited by examiner

*Primary Examiner*—M. Rachuba
(74) *Attorney, Agent, or Firm*—Birch, Stewart, Kolasch & Birch, LLP

(57) ABSTRACT

A pocketknife has a handle, a blade, a lock assembly and a pivot pin assembly. The handle has a lower cover, an upper cover, a block and a blade lock. The blade is mounted pivotally in the handle and has a curved guide. The lock assembly is mounted in the handle and has a safety lock and a latch. The safety lock is attached to the blade and has a latch guide. The latch is mounted in the handle and has a resilient latch tab. The latch tab corresponds to the curved guide on the blade and engages the latch guide on the safety lock when the blade is closed in the handle. The pivot pin assembly is mounted through the handle, the blade and the safety lock. The lock assembly keeps the closed blade from being opened unintentionally by external impact.

6 Claims, 8 Drawing Sheets

POCKETKNIFE WITH A LOCK ASSEMBLY

BACKGROUND OF THE INVENTION

1. Field of the Invention

The present invention relates to a knife, and more particularly to a pocketknife with a lock assembly that securely holds a blade when the blade is enclosed in a handle.

2. Description of Related Art

Pocketknives are generally used to cut or pare articles and are compact for carriage.

A conventional pocketknife has a hollow handle, a blade and a spring. The blade is mounted pivotally in the handle. The spring is connected between the blade and the handle. The blade in the handle can be pivoted manually out of the handle and the spring supplies a resilient force to spring the blade out. However, the blade with the resilient force may spring out with an inadvertently external impact and hurt a person carrying such a knife.

To overcome the shortcomings, the present invention provides a pocketknife with a lock assembly to mitigate or obviate the aforementioned problem.

SUMMARY OF THE INVENTION

The main objective of the invention is to provide a pocketknife with a lock assembly that securely holds a closed blade inside a handle and keeps the blade from being opened unintentionally by external impact.

A pocketknife in accordance with the present invention comprises a handle, a blade, a lock assembly and a pivot pin assembly.

The handle has a lower cover, an upper cover, a block and a blade lock.

The blade is mounted pivotally in the handle and has a curved guide.

The lock assembly is mounted in the handle and has a safety lock and a latch. The safety lock is attached to the blade and has a latch guide. The latch is mounted in the handle and has a resilient latch tab. The latch tab corresponds to the curved guide on the blade and engages the latch guide on the safety lock when the blade is closed in the handle.

The pivot pin assembly is mounted through the handle, the blade and the safety lock.

Other objectives, advantages and novel features of the invention will 11 become more apparent from the following detailed description when taken in conjunction with the accompanying drawings.

DETAILED DESCRIPTION OF PREFERRED EMBODIMENT

Figure 1:
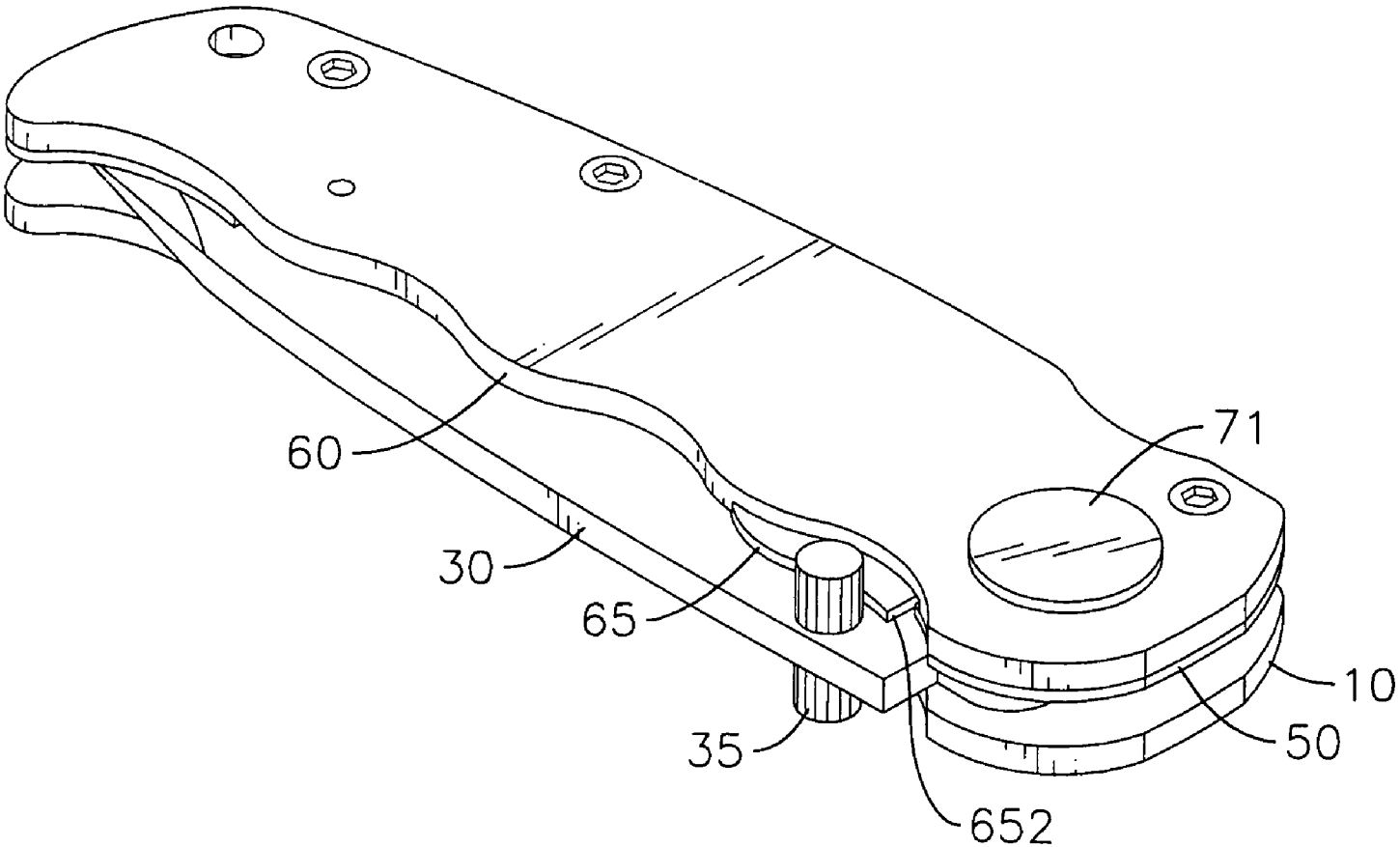
FIG. 1 is a perspective view of a pocketknife with a lock assembly in accordance with the present invention, and in a closed status.
Figure 2:
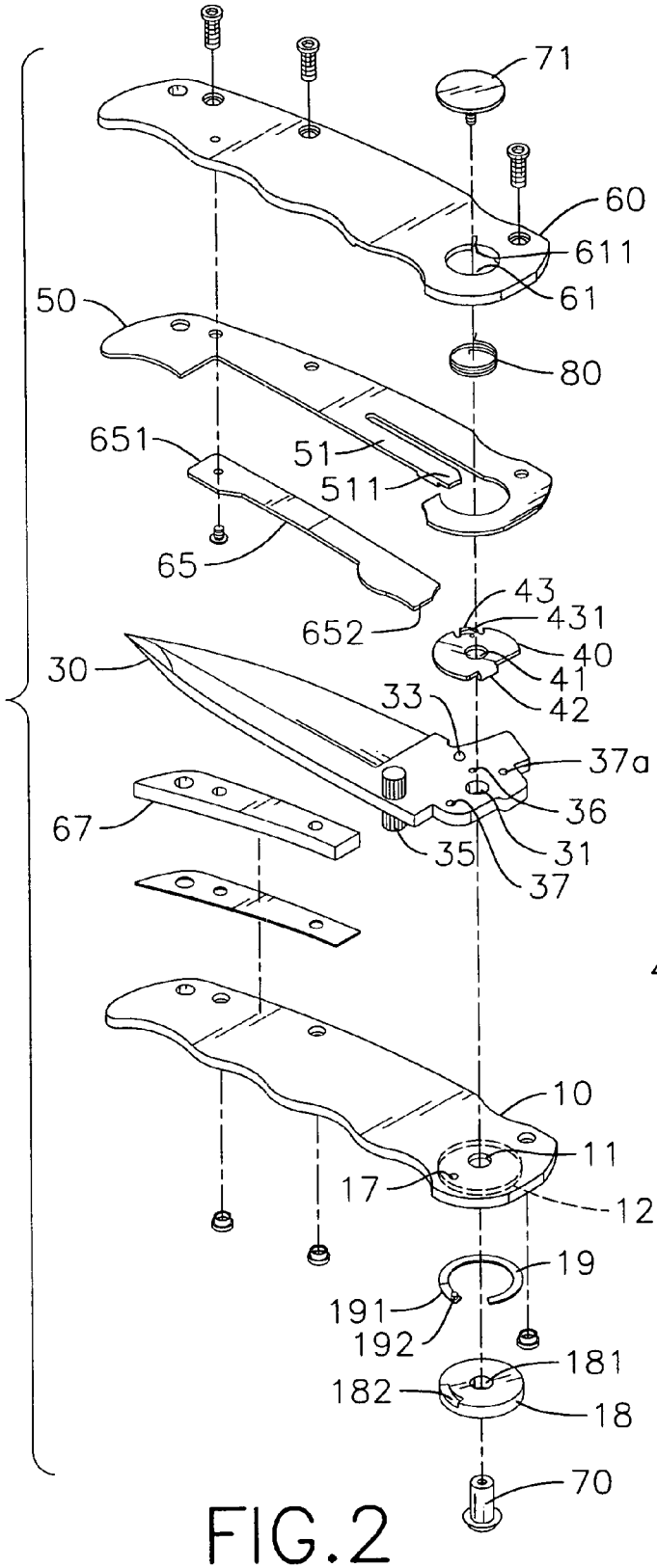
FIG. 2 is an exploded perspective view of the pocketknife in FIG. 1.

With reference to FIGS. 1 and 2, a pocketknife in accordance with the present invention comprises a handle, a blade (30), a lock assembly, an auxiliary lock assembly, a pivot pin assembly and a spring (80).

The handle has a lower cover (10), an upper cover (60), a block (67) and a blade lock (65).

The lower cover (10) has an outside surface, a proximal end, a pivot hole (11), a recess (12) and a through hole (17). The pivot hole (11) is defined through the lower cover (10) and is close to the proximal end. The recess (12) is defined coaxially around the pivot hole (11) in the outside surface. The through hole (17) is defined through the recess (12) in the lower cover (10). The upper cover (60) is mounted to the lower cover (10) and has a proximal end and a pivot hole (61). The pivot hole is defined through the upper cover (60) and is close to the proximal end and has an inner edge and a notch (611) defined in the inner edge.

The block (67) is mounted between the lower cover (10) and the upper cover (60).

The blade lock (65) is resilient, is mounted between the block (67) and the upper cover (60) and has a proximal end (651) and a distal end (652). The proximal end (651) is mounted securely between the block (67) and the upper cover (60).

Figure 5:
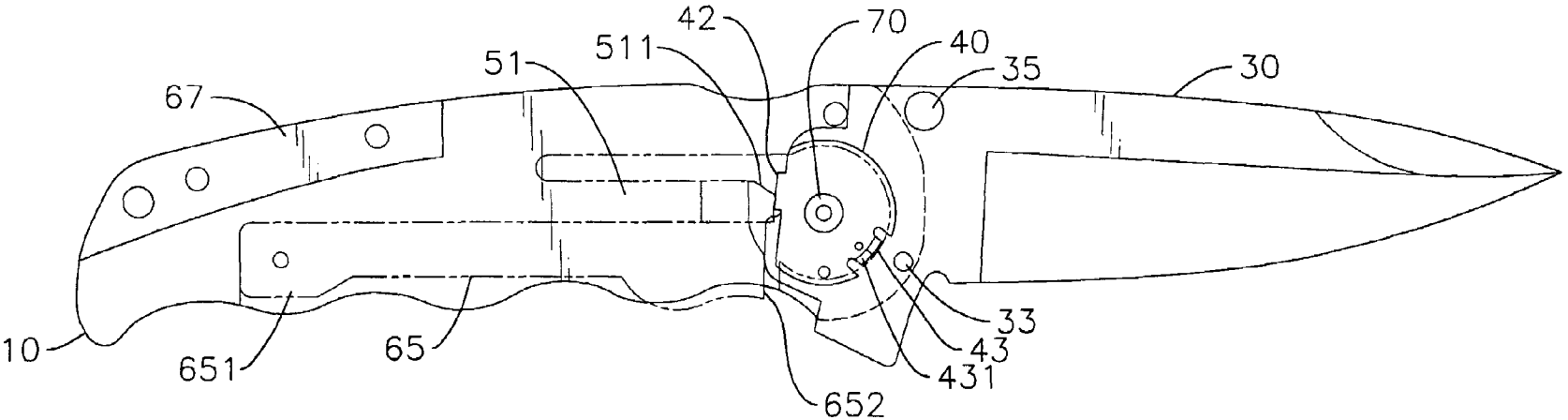
FIG. 5 is an operational top view of the pocketknife in FIG. 4 with the blade in a fully-opened status.

With further reference to FIG. 5, the blade (30) is mounted pivotally between the proximal ends of the lower cover (10) and the upper cover (60) and is locked by the distal end (652) of the blade lock (65) when the blade is open (30). Flexing the distal end (652) of the blade lock (65) sideways from the lower cover (10) releases the blade (30) so that the blade (30) can be pivoted into the handle. The blade (30) has a proximal end, two sides, a cutting edge, two locking holes (37, 37*a*), a pivot hole (31), a curved guide (33), a mounting hole (36) and two knobs (35).

The cutting edge corresponds to the block (67) in the handle and is adjacent to the block (67) when the blade (30) is closed in the handle.

The locking holes (37, 37*a*) are defined through the blade (30) and are close to the proximal end. The pivot hole (31) is defined through the blade (30) and is close to the proximal end and is located centrally between the locking holes (37, 37*a*).

The curved guide (33) is formed on one side of the blade (30).

The mounting hole (36) is defined through the blade (30).

The knobs (35) extend respectively from the sides of the blade (30) so that a user can push one of the knobs (35) and open the blade (30) by using a finger.

The lock assembly is mounted in the handle and has a safety lock (40) and a latch (50).

Figure 2A:
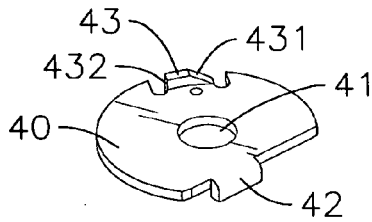
FIG. 2A is an enlarged view of the safety lock of the pocketknife in FIG. 2.

With further reference to FIG. 2A, the safety lock (40) is attached to one side of the blade (30) on the proximal end, is close to the curved guide (33) and has an outer edge, a pivot hole (41), an alignment hook (42), a latch guide (43) and a mounting hole. The pivot hole (41) is defined through the safety lock (40). The alignment hook (42) extends from the outer edge and hooks the proximal end of the blade (30) so that the blade (30) can pivot with the safety lock (40). The latch guide (43) extends from the outer edge and has an inclined outer edge (431) and an upright outer edge (432). The mounting hole is defined through the safety lock (40).

Figure 3:
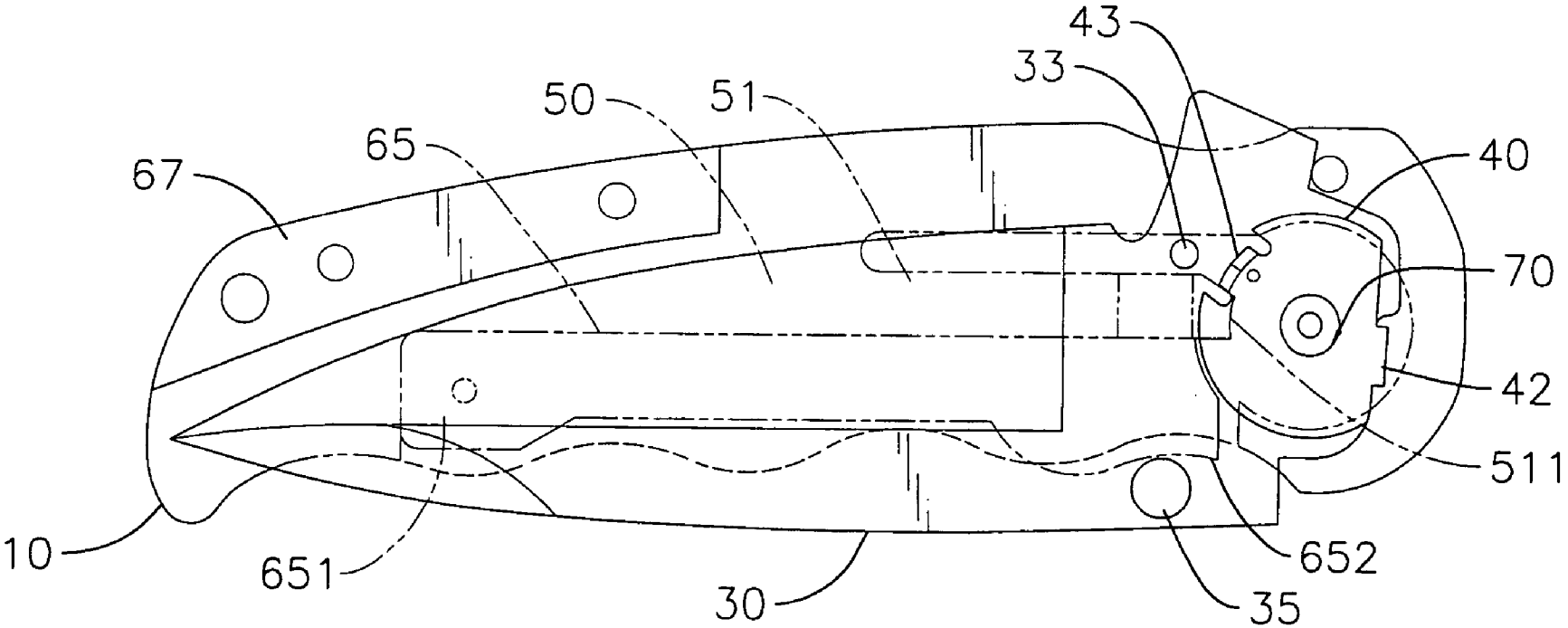
FIG. 3 is a top view of the pocketknife in FIG. 1 with the blade being closed.
Figure 4:
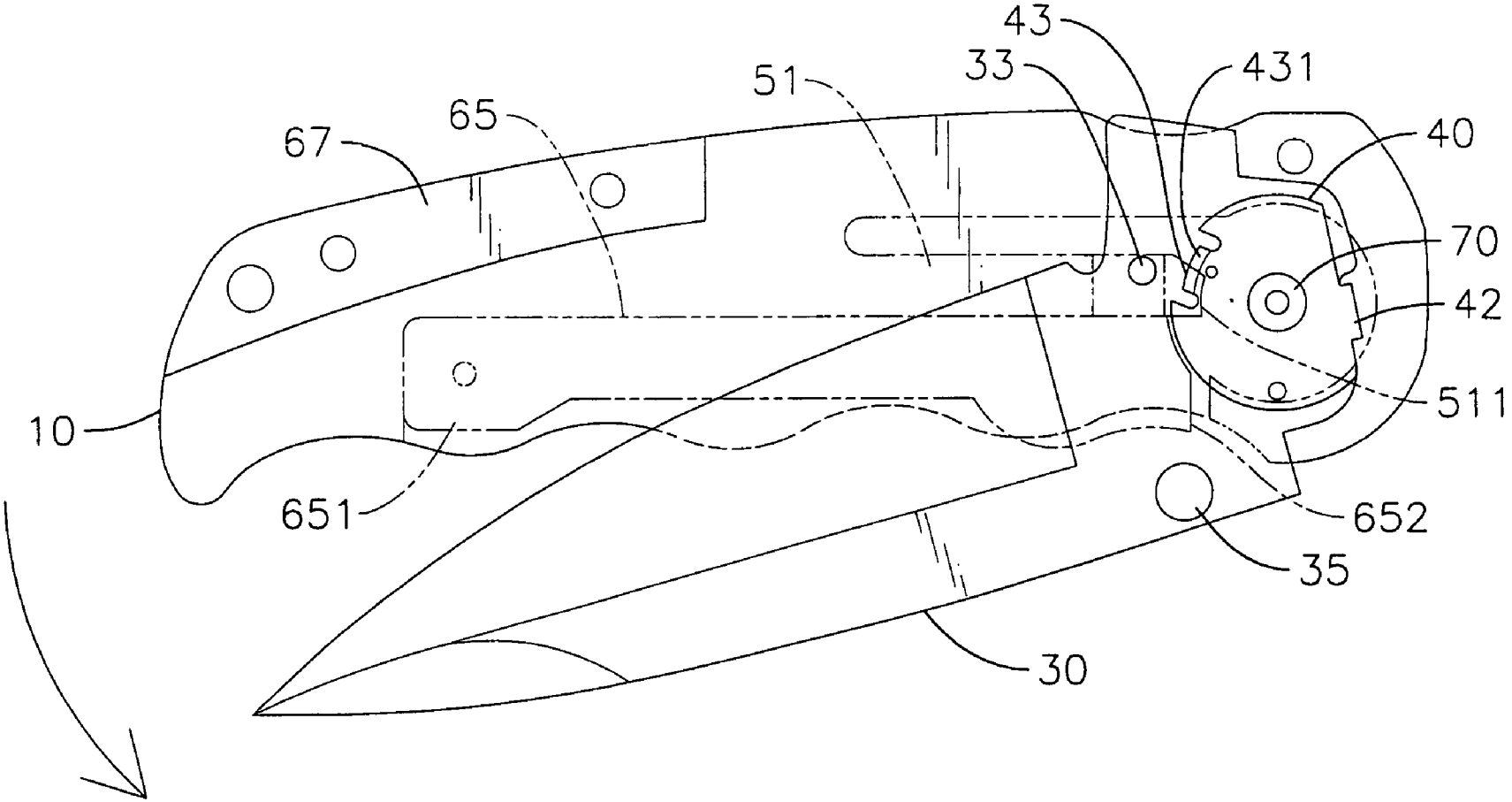
FIG. 4 is an operational top view of the pocketknife in FIG. 3 with the curved guide on the safety lock lifting up the distal end of the latch tab when the blade is pivoting out of the handle.
Figure 3A:
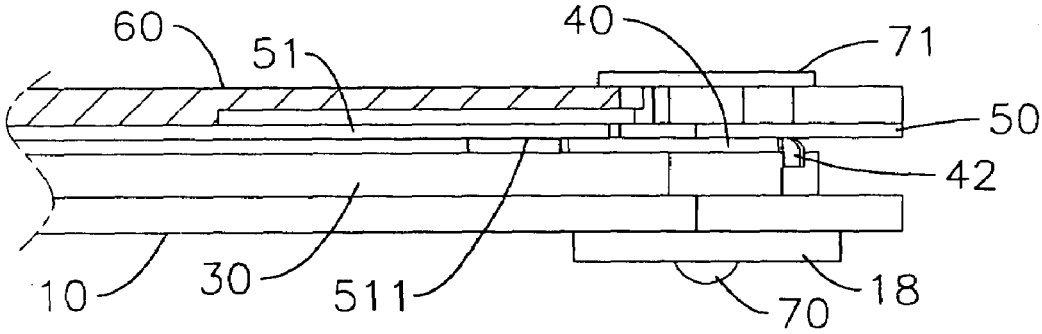
FIG. 3A is a front partial view of the pocketknife in FIG. 3.
Figure 4A:
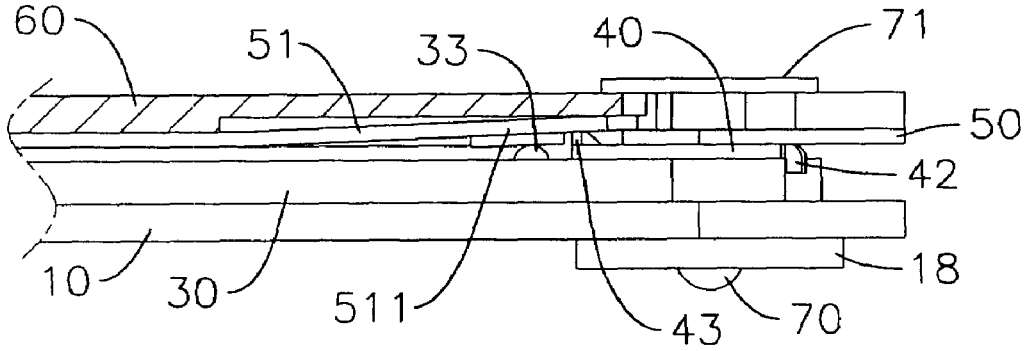
FIG. 4A is an operational front view of the pocketknife in FIG. 4.
Figure 6:
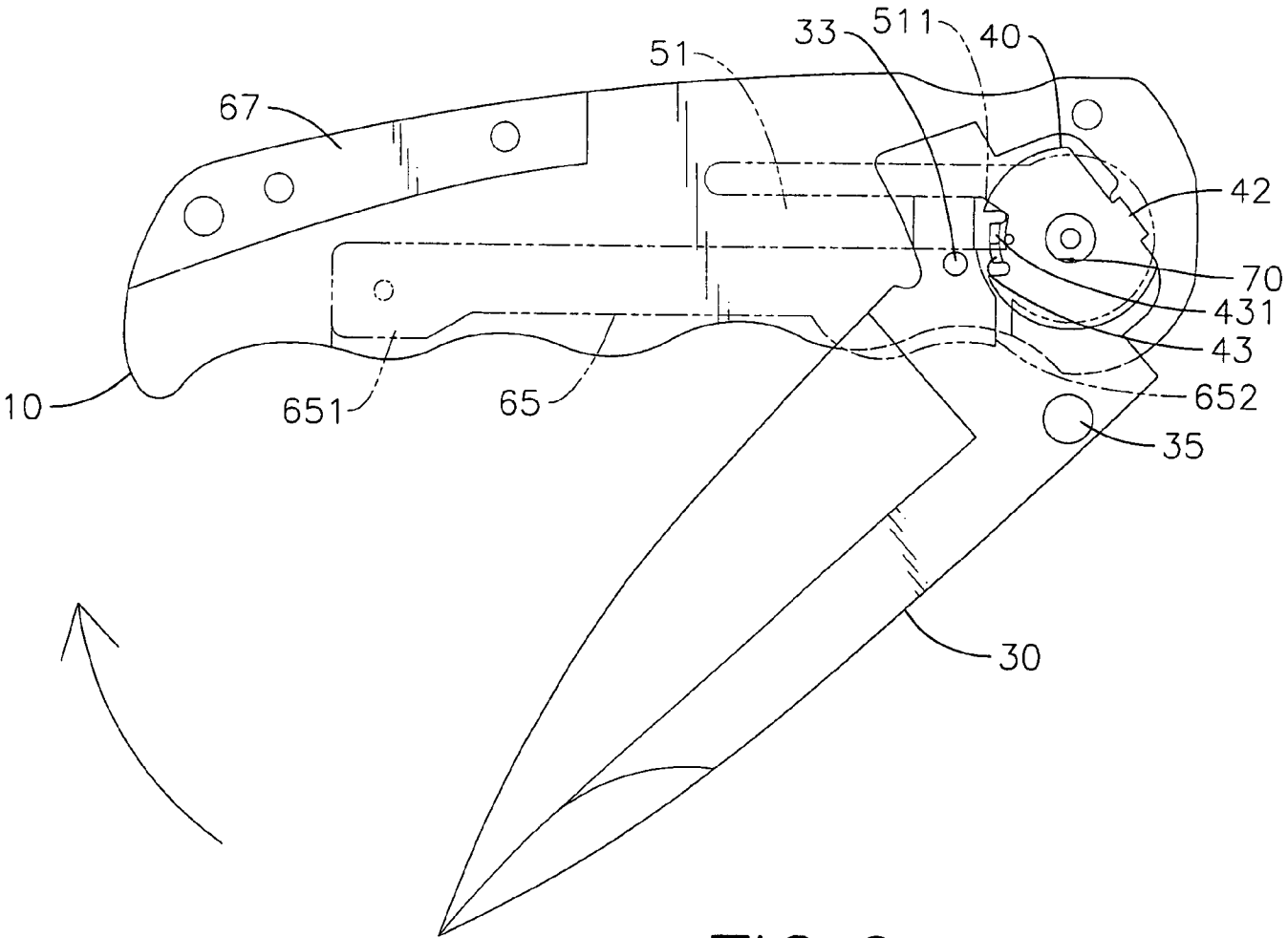
FIG. 6 is an operational top view of the pocketknife in FIG. 5 with the blade being pivoted into in the handle.

With reference to FIGS. 3 and 3A, the latch (50) is mounted between the blade lock (65) and the upper cover (60) and has a latch tab (51). The latch tab (51) is resilient, is formed on the latch (50) and has a distal end (511) which corresponds to the curved guide (33) on the blade (30) and detachably engages the latch guide (43) on the safety lock (40) by abutting the upright outer edge (432). The distal end (511) of the latch tab (51) abuts against the upright outer edge (432) of the latch guide (43) to lock the blade (30) closed in the handle. With reference to FIGS. 4 and 4A, the curved guide (33) passes across and lifts the distal end (511) of the latch tab (51) when the blade (30) is being pivoted out of the handle so that the latch guide (43) on the safety lock (40) passes across the lifted distal end (511) of the latch tab (51). The blade (30) is then open. With reference to FIG. 6, the distal end (511) of the latch tab (51) is guided by the inclined outer edge (431) of the latch guide (43) on the safety lock (40) when the blade (30) is pivoting into the handle. The blade (30) is received completely in the handle after the latch guide (43) passes across the latch tab (51).

Figure 7:
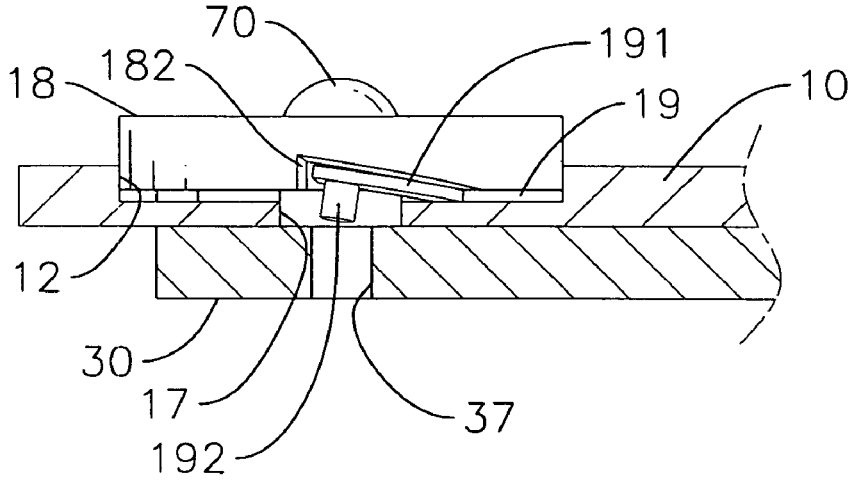
FIG. 7 is an overturned front view of the pocketknife in FIG. 1 with the auxiliary lock and the locking knob.
Figure 8:
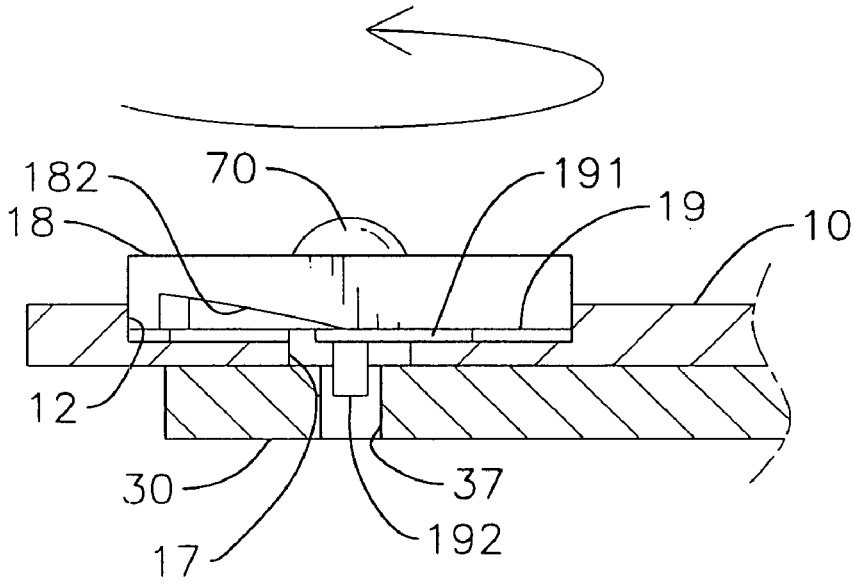
FIG. 8 is an operational overturned front view of the pocketknife in FIG. 7 with the auxiliary lock locking the blade.

With reference to FIGS. 7 and 8, the auxiliary lock assembly is mounted in the lower cover (10) and has an auxiliary lock (19) and a locking knob (18).

The auxiliary lock (19) is C-shaped, is mounted securely in the recess (12) in the lower cover (19) and has a level segment, an inclined segment (191) and a locking pin (192). The inclined segment (191) is resilient and extends up from the level segment. The locking pin (192) is formed on the inclined segment (191), aligns with the through hole (17) in the lower cover (10) and corresponds to the locking holes (37, 37*a*) in the blade (30).

Still referring to FIGS. 7 and 8, and further to FIG. 2, the locking knob (18) is mounted rotatably in the recess (12) in the lower cover (10), and rotatably abuts the auxiliary lock (19). The locking knob (18) selectively presses against the inclined segment (191) to extend the locking pin (192) through the through hole (17) in the lower cover (10) and one of the locking holes (37, 37*a*) in the blade (30) so the opened or closed blade (30) is held securely. The locking knob (18) has a pivot hole (181) and an inclined recess (182). The pivot hole (181) is defined through the locking knob (18). The inclined recess (182) is defined in the locking knob (18) and accommodates the inclined segment (191) of the auxiliary lock (19) when aligning the inclined segment (191).

The pivot pin assembly is mounted through the handle, the blade (30), the safety lock (40) and the auxiliary lock assembly, and has a pivot pin (70) and a fastener (71).

The pivot pin (70) is mounted through pivot holes (11, 31, 40, 61) respectively in the lower cover (10), the blade (30), the safety lock (40) and the upper cover (60) and has a proximal end, a distal end, an enlarged head and a mounting hole. The enlarged head is formed on the proximal end of the pivot pin (70) outside the lower cover (10) or the locking knob (18). The mounting hole is defined in the distal end of the pivot pin (70) and may have an inner thread.

The fastener (71) has a tip which is mounted in the mounting hole in the pivot pin, abuts the upper cover (60) and may be a bolt with an outer thread corresponding to the inner thread in the mounting hole in the pivot pin (70).

Still referring to FIGS. 2, 7 and 8, the spring (80) is mounted in the pivot hole (61) of the upper cover (60), is connected to the upper cover (60) and blade (30), provides a resilient force to the pivot out the blade (30) and has two ends. One end of the spring (80) extends in the notch (611) in the upper cover (611) and the other end is mounted through the mounting hole in the safety lock (40) and the mounting hole (36) in the blade (30).

The lock assembly securely holds the closed blade (30) inside the handle and keeps the blade (30) from being opened by external impact so that the safety of the pocketknife is improved. Furthermore, the auxiliary lock (19) and the locking knob (18) securely holding the blade (30) being open or closed further provides a security to the pocketknife.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A pocketknife comprising:

a handle having a lower cover having an outside surface, a proximal end and a pivot hole defined through the lower cover and close to the proximal end;

an upper cover mounted to the lower cover and having a proximal end and a pivot hole defined through the upper cover and close to the proximal end and having an inner edge;

a block mounted between the lower cover and the upper cover; and a blade lock being resilient and having a proximal end mounted securely between the block and the upper cover and a distal end;

a blade mounted pivotally between the proximal ends of the lower cover and the upper cover and having a proximal end, two sides, a cutting edge corresponding to the block in the handle, a pivot hole defined through the blade and close to the proximal end, a mounting hole defined through the blade, and a curved guide formed on one side of the blade;

a lock assembly mounted in the handle and having a safety lock attached to the blade on the proximal end and close to the curved guide and having a pivot hole defined through the safety lock;

an alignment hook extending from the safety lock and hooking the proximal end of the blade; and a latch guide extending from the safety lock and having an inclined outer edge and an upright outer edge;

a latch mounted between the blade lock and the upper cover and having a latch tab being resilient, formed on the latch and having a distal end corresponding to the curved guide on the blade and detachably engaging the latch guide on the safety lock by abutting the upright outer edge; and a pivot pin assembly having a pivot pin mounted through pivot holes respectively in the lower cover, the blade, the safety lock and the upper cover and having a proximal end, a distal end, an enlarged head formed on the proximal end outside the lower cover and a mounting hole defined in the distal end; and a fastener mounted in the mounting hole in the pivot pin and abutting the upper cover.

2. The pocketknife as claimed in claim 1, wherein:

the lower cover further has a recess defined coaxially around the pivot hole in the outside surface and a through hole defined through the recess in the lower cover;

the pocketknife further comprises an auxiliary lock assembly mounted in the lower cover and having an auxiliary lock being C-shaped, mounted securely in the recess in the lower cover and having a level segment;

an inclined segment being resilient and extending up from the level segment; and a locking pin formed on inclined segment, aligning with the through hole in the lower cover and corresponding to the locking holes in the blade; and a locking knob mounted rotatably in the recess in the lower cover, rotatably abutting the auxiliary lock and having a pivot hole through which the pivot pin extends and an inclined recess defined in the locking knob and accommodating the inclined segment of the auxiliary lock when aligning the inclined segment.

3. The pocketknife as claimed in claim 1, wherein:

the pivot hole of the upper cover further has a notch defined in the inner surface of the inner edge;

the blade further has a mounting hole defined through the blade;

the safety lock further has a mounting hole defined through the safety lock; and the pocketknife further has a spring mounting in the pivot hole of the upper cover and having two ends, and one end of the spring extends in the notch in the upper cover and the other end is mounted through the mounting holes respectively in the safety lock on the blade.

4. The pocketknife as claimed in claim 2, wherein:

the pivot hole of the upper cover further has a notch defined in the inner surface of the inner edge;

the blade further has a mounting hole defined through the blade;

the safety lock further has a mounting hole defined through the safety lock; and the pocketknife further has a spring mounting in the pivot hole of the upper cover and having two ends, and one end of the spring extends in the notch in the upper cover and the other end is mounted through the mounting holes respectively in the safety lock on the blade.

5. The pocketknife as claimed in claim 3, wherein the mounting hole of the pivot pin has an inner thread and the fastener is a bolt and has an outer thread corresponding to the inner thread.

6. The pocketknife as claimed in claim 4, wherein the mounting hole of the pivot pin has an inner thread and the fastener is a bolt and has an outer thread corresponding to the inner thread.

* * * * *